US012214264B2

(12) United States Patent
Sada, Jr.

(10) Patent No.: US 12,214,264 B2
(45) Date of Patent: Feb. 4, 2025

(54) GOLF CLUB HEAD FOR IMPROVING SHOT DISTANCE AND ACCURACY

(71) Applicant: Carlos Sada, Jr., McAllen, TX (US)

(72) Inventor: Carlos Sada, Jr., McAllen, TX (US)

( * ) Notice: Subject to any disclaimer, the term of this patent is extended or adjusted under 35 U.S.C. 154(b) by 637 days.

(21) Appl. No.: 17/493,950

(22) Filed: Oct. 5, 2021

(65) Prior Publication Data

US 2022/0105395 A1 Apr. 7, 2022

Related U.S. Application Data

(60) Provisional application No. 63/087,834, filed on Oct. 5, 2020.

(51) Int. Cl.
*A63B 53/04* (2015.01)

(52) U.S. Cl.
CPC ..... *A63B 53/0445* (2020.08); *A63B 53/0408* (2020.08); *A63B 53/0466* (2013.01)

(58) Field of Classification Search
CPC ..... A63B 53/0445; A63B 53/0408; A63B 53/0466; A63B 2225/01; A63B 60/50
See application file for complete search history.

(56) References Cited

U.S. PATENT DOCUMENTS

| | | | | |
|---|---|---|---|---|
| 3,468,544 | A | 9/1969 | Antonious | |
| D242,479 | S | 11/1976 | Panek | |
| D285,231 | S * | 8/1986 | Solomon | D21/733 |
| 4,809,982 | A | 3/1989 | Kobayashi | |
| D353,176 | S | 12/1994 | Poggi | |
| D356,130 | S | 3/1995 | Schield | |
| D470,202 | S | 2/2003 | Tunno | |
| D481,430 | S | 10/2003 | Tunno | |
| D812,165 | S | 3/2018 | Kitching, Jr. | |
| 2006/0281580 | A1* | 12/2006 | Kim | A63B 53/0466 473/342 |

* cited by examiner

*Primary Examiner* — Jeffrey S Vanderveen
(74) *Attorney, Agent, or Firm* — Outlier Patent Attorneys, PLLC

(57) ABSTRACT

A golf club head includes a ball striking surface having a plurality of openings therethrough. The plurality of openings in the ball striking surface may be a cluster of openings positioned in a central portion of the ball striking surface. The golf club head further includes an exhaust opening in a top portion adjacent to a rear portion of the golf club head. An internal air flow cavity is coupled to the plurality of openings and the exhaust opening so that air enters the air flow cavity through the plurality of openings and exits the cavity through the exhaust opening. The golf club head may further include an air inlet opening in a bottom portion of the golf club head adjacent to the ball striking surface.

6 Claims, 5 Drawing Sheets

GOLF CLUB HEAD FOR IMPROVING SHOT DISTANCE AND ACCURACY

CROSS-REFERENCE TO RELATED APPLICATIONS

This application claims priority to U.S. Provisional Patent Application Ser. No. 63/087,834, filed Oct. 5, 2020, entitled "GOLF CLUB HEAD FOR IMPROVING SHOT DISTANCE AND ACCURACY," the entire contents of which are incorporated herein by reference.

BACKGROUND

Field of Art

This disclosure relates to sports equipment. More specifically, the present invention is directed to a golf club head for improving shot performance.

Background

Golfers have been trying to find technological solutions to improve their shot performance since the advent of the sport. A large variety of solutions have been proposed, some of which have been co-opted into the sport. A significant number of these efforts have centered around improving the shape of the golf club head to make it more aerodynamic and therefore faster. However, these efforts have not yielded significant positive returns because golf club head designs, by necessity, are limited by the size and shape of the front face or the strike plate that makes contact with the golf club. Often the size and the shape of the strike plate (also commonly referred to as the face) is regulated by game or club regulations and therefore cannot be substantially changed within the confines of available rules.

Others have tried to overcome these issues by improving the materials or substances used to make the strike plate and/or the golf club head. Some materials transfer greater force when struck, which allows a golf ball to compress more and travel further when struck. However, this design feature has its own set of tradeoffs. Using these materials often reduces the accuracy of the golf club because if a ball is mis-struck or struck slightly off-center—then the ball may travel in an unintended direction with greater force than with a normal club head.

Some have tried to overcome these limitations by adding attachments and/or weights to improve the speed of the golf club when it is swung. But these attachments are difficult to use and/or optimize for an average golfer. Moreover, these methods tend to improve the swing performance of golfers but do not necessarily or inherently improve ball flight or distance (other than the improvements caused by an improved swing).

SUMMARY

The present invention overcomes many of these limitations by integrating airflow vents that extend through the interior portion of the golf club head. More specifically, the air flow vents extend from the front of the golf club (i.e. from the strike plate) through to the back portion of the golf club head. Importantly, the airflow vents are strategically placed to increase the time of contact between the golf club head and the golf ball when the ball is struck with the golf club. Additionally, the airflow vents are strategically designed and placed to improve the aerodynamics of the golf club head, which allows it to have a faster swing speed under normal conditions.

More specifically, the present invention is for an improved golf club head that improves shot distance without sacrificing accuracy. Generally, the improved golf club head of the present invention enables faster club head speed (thereby improving shot distance or distance travelled by a ball that is struck by the improved golf club) by reducing drag or resistance that is typically encountered during the golf club swing phase. Moreover, the improved golf club head of the present invention improves shot distance by increasing the time of contact between the club head face and the golf ball. As described in more detail below, the inventive golf club head generates suction between the golf club head and the golf ball when the ball is struck. The suction enables the golf club head to sustain contact with the golf ball for a slightly longer period of time, which allows additional energy to be transferred from the golf club head to the ball by enabling the golf ball to compress more than it would with a traditional golf club head. The additional compression/energy translates in greater flight distance when a golf ball is struck by the inventive golf club. Finally, the improved golf club head of the present invention does not reduce the accuracy of the golf shot. The method of improving the time of flight of the golf ball described herein does not cause a design trade off between shot accuracy and shot distance.

The present invention is a golf club head that includes a ball striking surface having a plurality of openings therethrough. The plurality of openings in the ball striking surface may be a cluster of openings positioned in a central portion of the ball striking surface. The cluster of openings may have a height of 1.25-1.75 inches and a width of 2.25-2.75 inches. The ball striking surface may have a region configured to make contact with a golf ball, and the plurality of openings may be positioned in or around the region.

The golf club head further includes a rear portion opposite of the ball striking surface, a top portion coupled to the ball striking surface and the rear portion, and a bottom portion opposite of the top portion, wherein the bottom portion is coupled to the ball striking surface and the rear portion. The golf club head further includes an exhaust opening in the top portion adjacent to the rear portion. An internal air flow cavity is coupled to the plurality of openings and the exhaust opening so that air enters the air flow cavity through the plurality of openings and exits the cavity through the exhaust opening.

The golf club head may further include an air inlet opening in the bottom portion adjacent to the ball striking surface of the golf club head. An internal ridge may be disposed in the internal air flow cavity, and may be positioned between the plurality of openings and the air inlet opening. The internal ridge may be configured to direct air flow from the plurality of openings and the air inlet opening towards the exhaust opening.

BRIEF DESCRIPTION OF THE DRAWING FIGURES

The accompanying drawings illustrate several embodiments and, together with the description, serve to explain the principles of the invention according to the embodiments. It will be appreciated by one skilled in the art that the particular arrangements illustrated in the drawings are merely exemplary and are not to be considered as limiting of the scope of the invention or the claims herein in any way.

DETAILED DESCRIPTION OF EMBODIMENTS

Figure 1:
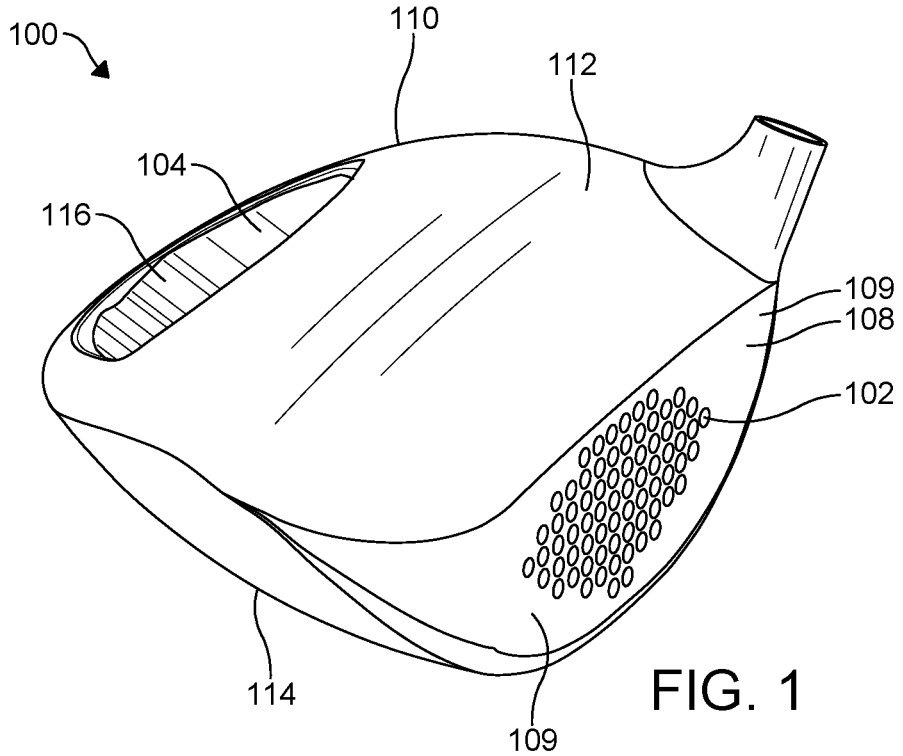
FIG. 1 is a perspective view of the top and front of an exemplary golf club head in accordance with an embodiment of the invention.

The present invention is for an improved golf club head comprising strike plate apertures and an exhaust opening in the top portion of the golf club head. The golf club head may further include a bottom opening. The openings enable air to flow through the interior cavity of the golf club head, wherein air may enter from the strike plate apertures and (optional) bottom opening and exit the interior cavity from the exhaust opening. The invention is described by reference to various elements herein. It should be noted, however, that although the various elements of the inventive apparatus are described separately below, the elements need not necessarily be separate. The various embodiments may be interconnected and may be cut out of a singular block or mold. The variety of different ways of forming an inventive apparatus, in accordance with the disclosure herein, may be varied without departing from the scope of the invention.

Generally, one or more different embodiments may be described in the present application. Further, for one or more of the embodiments described herein, numerous alternative arrangements may be described; it should be appreciated that these are presented for illustrative purposes only and are not limiting of the embodiments contained herein or the claims presented herein in any way. One or more of the arrangements may be widely applicable to numerous embodiments, as may be readily apparent from the disclosure. In general, arrangements are described in sufficient detail to enable those skilled in the art to practice one or more of the embodiments, and it should be appreciated that other arrangements may be utilized and that structural changes may be made without departing from the scope of the embodiments. Particular features of one or more of the embodiments described herein may be described with reference to one or more particular embodiments or figures that form a part of the present disclosure, and in which are shown, by way of illustration, specific arrangements of one or more of the aspects. It should be appreciated, however, that such features are not limited to usage in the one or more particular embodiments or figures with reference to which they are described. The present disclosure is neither a literal description of all arrangements of one or more of the embodiments nor a listing of features of one or more of the embodiments that must be present in all arrangements.

Headings of sections provided in this patent application and the title of this patent application are for convenience only and are not to be taken as limiting the disclosure in any way.

Devices and parts that are connected to each other need not be in continuous connection with each other, unless expressly specified otherwise. In addition, devices and parts that are connected with each other may be connected directly or indirectly through one or more connection means or intermediaries.

A description of an aspect with several components in connection with each other does not imply that all such components are required. To the contrary, a variety of optional components may be described to illustrate a wide variety of possible embodiments and in order to more fully illustrate one or more embodiments. Similarly, although process steps, method steps, or the like may be described in a sequential order, such processes and methods may generally be configured to work in alternate orders, unless specifically stated to the contrary. In other words, any sequence or order of steps that may be described in this patent application does not, in and of itself, indicate a requirement that the steps be performed in that order. The steps of described processes may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to one or more of the embodiments, and does not imply that the illustrated process is preferred. Also, steps are generally described once per aspect, but this does not mean they must occur once, or that they may only occur once each time a process, or method is carried out or executed. Some steps may be omitted in some embodiments or some occurrences, or some steps may be executed more than once in a given aspect or occurrence.

When a single device or article is described herein, it will be readily apparent that more than one device or article may be used in place of a single device or article. Similarly, where more than one device or article is described herein, it will be readily apparent that a single device or article may be used in place of the more than one device or article.

The functionality or the features of a device may be alternatively embodied by one or more other devices that are not explicitly described as having such functionality or features. Thus, other embodiments need not include the device itself.

Techniques and mechanisms described or referenced herein will sometimes be described in singular form for clarity. However, it should be appreciated that particular embodiments may include multiple iterations of a technique or multiple instantiations of a mechanism unless noted otherwise. Alternate implementations are included within the scope of various embodiments in which, for example, functions may be executed out of order from that shown or discussed, including substantially concurrently or in reverse order, depending on the functionality involved, as would be understood by those having ordinary skill in the art.

Figure 2:
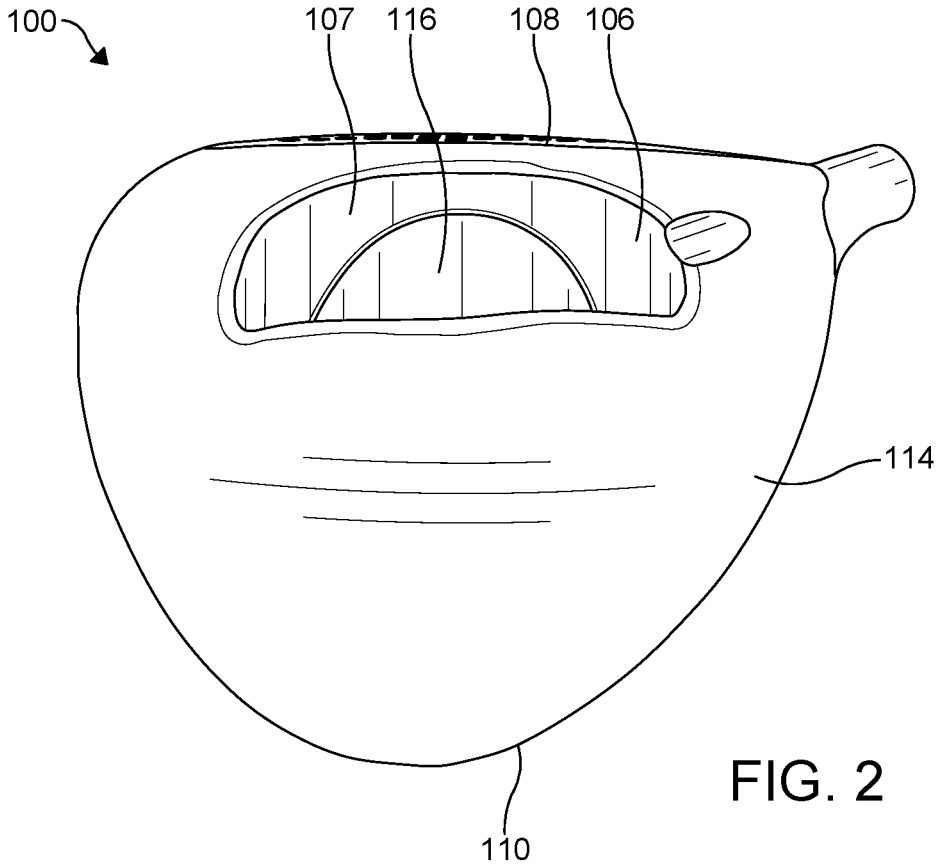
FIG. 2 is a bottom view of an exemplary golf club head in accordance with an embodiment of the invention.
Figure 3:
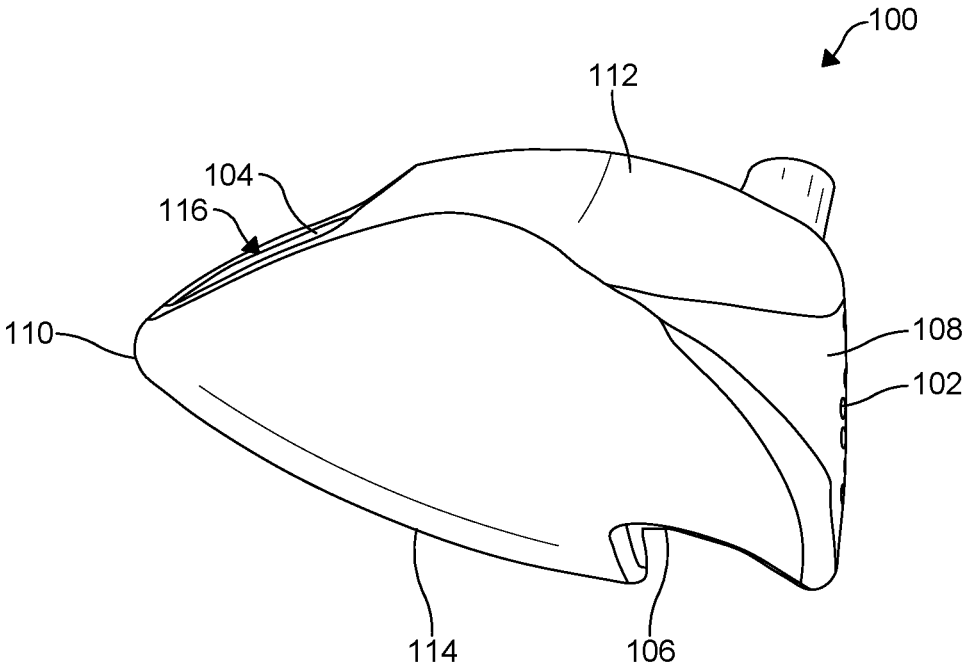
FIG. 3 is a side view of an exemplary golf club head in accordance with an embodiment of the invention.

FIGS. 1, 2, and 3 illustrate an exemplary embodiment of the inventive apparatus, which is a golf club head 100 that includes strike plate apertures 102, a bottom opening 106, and an exhaust opening 104. Each element is described in greater detail below.

As illustrated in FIG. 1, the golf club head 100 has a ball striking surface (or face) 108 intended to make contact with a golf ball when a golf club that includes the illustrated golf club head 100 is swung towards the golf ball. The golf club head 100 also has a rear portion 110 opposite of the ball striking surface 108, a top portion (or crown) 112, and a bottom portion (or sole) 114. The strike plate apertures 102 are comprised of one or more openings that are specifically placed at or near the center portion of the ball striking surface 108. The central portion of the face 108 of the golf club head 100 is considered a "sweet spot" where the golf club head 100 ideally makes contact with the golf ball for optimal performance. In one embodiment, the apertures 102 are positioned solely and exclusively in the sweet spot of the face 108.

A variety of different apertures 102 may be used without departing from the scope of the invention as long as they are placed at or near the center portion of the ball striking surface 108. In one embodiment, a single aperture 102 may be used. In other embodiments, as illustrated in FIG. 1, seventy-two apertures 102 may be provided. The specific number of apertures 102 may vary as long as they are placed at or around the region where the ball striking surface 108 of the golf club head 100 is designed to make contact with a golf ball when the club is swung. While the central portion of the ball striking surface 108 includes the plurality of apertures 102, the sides 109 at the heel and toe of the ball striking surface 108 may be solid. In other words, the ball striking surface 108 includes a central portion having apertures 102 and solid side portions 109 that do not have apertures therethrough so that the apertures 102 are only positioned in the sweet spot of the ball striking surface 108. It has been found that adding apertures to the side portions 109 of the ball striking surface 108 reduces the accuracy of the golf club and negatively impacts a player's swing.

Additionally, a variety of different sizes of apertures 102 may be used without departing from the scope of the invention. In one embodiment, the apertures may be 0.128 inches in diameter. However, the apertures 102 may be slightly smaller or as large as half the size of a standard regulation golf ball. In one embodiment, the apertures 102 may be circular or semi-circular in shape. However, other shapes may be used without departing from the scope of the invention, including, but not limited to square shaped apertures, hexagon-shaped apertures, octagon-shaped apertures, etc.

More generally, a variety of different number of aperture and/or aperture diameters/sizes may be used without departing from the scope of the invention as long as the apertures 102 enable sufficient air to flow through an interior cavity 116 of the golf club head 100 to create a temporary suction between the golf club head 100 and the golf ball (when the golf ball is struck by the golf club). In one instance, the relationship between aperture 102 number and size may be roughly inverse. The larger the apertures 102 are, the fewer numbers may be needed, and vice versa to create sufficient temporary negative pressure such that the ball may remain on the face 108 of the golf club head 100 for a slightly longer period of time.

In one embodiment, a cluster of apertures 102 may be used without departing from the scope of the invention, as illustrated in FIG. 1. In one limiting embodiment, the cluster of apertures 102 may be disposed over the sweet spot of the golf club face 108. The cluster of apertures 102 may be approximately 2-3 inches wide, preferably 2.25-2.75 inches wide, and may be 1-2 inches high, preferably 1.25-1.75 inches high. In one embodiment, the cluster of apertures 102 is 2.60 inches wide at its widest point, and 1.39 inches long at its highest point. However, the height and/or the width of the aperture cluster may be slightly wider and/or slightly broader and/or slightly longer and/or slightly shorter without departing from the scope of the invention. In general, the size of the cluster of apertures 102 is sufficient to cover substantially the entire central portion of the golf club face 108, leaving solid side portions 109 at the heel and toe of the golf club face 108. As such, the apertures 102 are positioned solely and exclusively in the sweet spot of the face 108 of the golf club head 100.

FIG. 2 illustrates an exemplary embodiment of the golf club head 100 from a bottom plan view, including, specifically, the bottom opening 106. The bottom air inlet opening 106 is positioned in the bottom portion of the golf club head 100 adjacent to the ball striking surface 108. The bottom opening 106 also enables air to enter the interior cavity 116 of the golf club head 100. When the golf club is swung, a large volume of air may enter the interior cavity 116 of the golf club head 100 and exit via the exhaust opening 104 that is disposed towards the back end 110 of the golf club head 100. This volume of air reduces air resistance during the club swing and also helps to create a slight suction between the ball striking surface 108 and the golf ball.

FIG. 3 illustrates the inventive golf club head 100 of the present invention from a side plan view. More specifically, it illustrates the placement of the bottom air inlet opening 106 in accordance with an embodiment of the invention. In one embodiment of the invention, the bottom opening 106 is disposed on the sole (the bottom portion 114) of the golf club head 100. More specifically, the air inlet opening 106 is disposed on the sole 114 towards the front or the face 108 of the club head 100. This specific placement enables air to travel inside the bottom opening 106 in sufficient volume to create temporary suction between the golf club head 100 and the golf ball (when the ball is struck with the golf club). Moreover, this specific placement of the bottom opening 106 improves the stability of the golf club when it is swung by a golfer. For example, the bottom opening 106 directs air in a specific manner which prevents the golf club from wobbling in the pitch, yaw, and/or roll axes.

Figure 4:
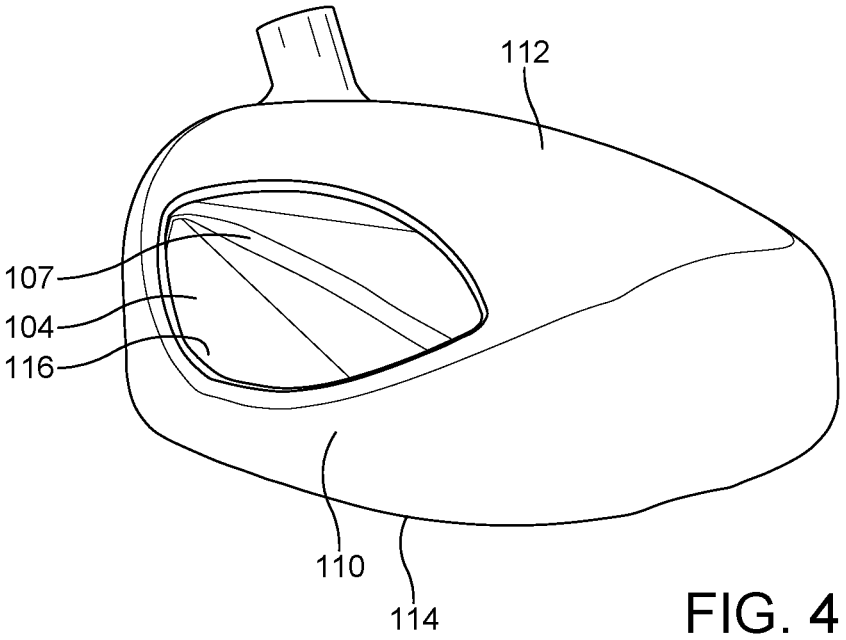
FIG. 4 is a perspective view of the rear portion of an exemplary golf club head in accordance with an embodiment of the invention.
Figure 5:
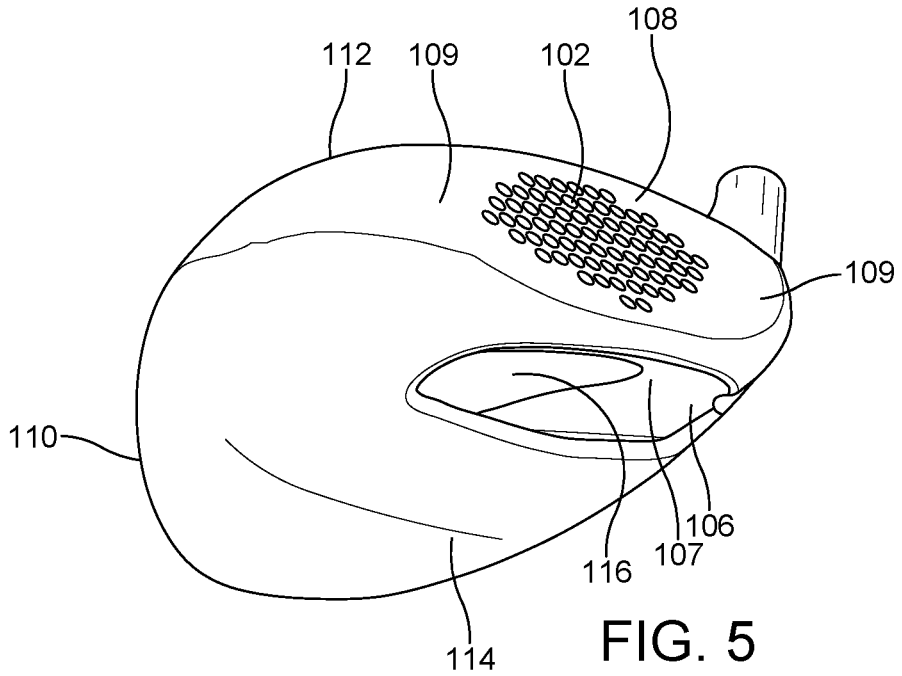
FIG. 5 is a perspective view of the bottom and front portions of an exemplary golf club head in accordance with an embodiment of the invention.

In one embodiment, the bottom opening 106 may be further comprised of an interior ridge 107, which is depicted in FIGS. 2, 4 and 5. The interior ridge 107 directs the airflow to move from the bottom opening 106 to the exhaust opening 104 in a manner that does not interfere or disrupt the swing performance of the golf club. In one embodiment, the interior ridge 107 is a few inches from the bottom opening 106. However, as would be readily understood by a person of ordinary skill in the art, the distance may vary without departing from the scope of the invention. The interior ridge 107 may additionally add structural support and strength to the golf club head 100.

FIGS. 1, 3, and 4 illustrate the exhaust opening 104 in accordance with an exemplary embodiment of the invention. The exhaust opening 104 permits air to flow out of the interior cavity 116 of the golf club head 100. As described above, the strike plate apertures 102 and the bottom opening 106 permit air to flow into the interior cavity 116 of the golf club head 100 when the golf club is swung by a golfer. During the swing phase, the air that has entered into the interior cavity 116 typically exits the interior cavity 116 via the exhaust opening 104. Moreover, as described elsewhere herein, the rapid motion of the golf club (for example, during the swing phase) forces the air to flow in and out of the golf club head's interior cavity 116 in the manner described herein. This forceful movement of air creates negative pressure or suction that enables the golf ball to remain attached to the face or the strike plate 108 for fractions of seconds longer than with a traditional golf club that does not have the airflow features described herein.

As illustrated in FIGS. 1, 3 and 4, the exhaust opening 104 is placed on the crown portion 112 of the golf club head 100 at or near the back 110 of the golf club head 100. This specific placement of the exhaust opening 104 enables the air to flow in a manner that stabilizes the golf club as it travels through the air when swung. For example, the air flows from the bottom portion of the golf club head to the top portion, which increases the downward rotational force that may be applied via the golf club during a golf swing. Moreover, the specific placement of the exhaust opening 104, which is towards the middle back of the golf club head 100 minimizes undesired movement along the yaw, pitch, and/or roll axes.

FIGS. 6-9 illustrate a golf club head 200 that is similar to the golf club head 100 illustrated in FIGS. 1-5, except that the golf club head 200 does not include an air inlet opening in the bottom portion of the golf club head 200. The golf club head 200 includes a ball striking surface 208 (shown in FIG. 7) having a plurality of apertures 202 therein. The apertures 202 are specifically placed at or near the center portion of the ball striking surface 208 so that the ball striking surface 208 has solid side portions 209 at the heel and toe that do not have apertures therethrough. In one embodiment, the apertures 202 are positioned solely and exclusively in the sweet spot of the face 208 of the golf club head 200.

Figure 6:
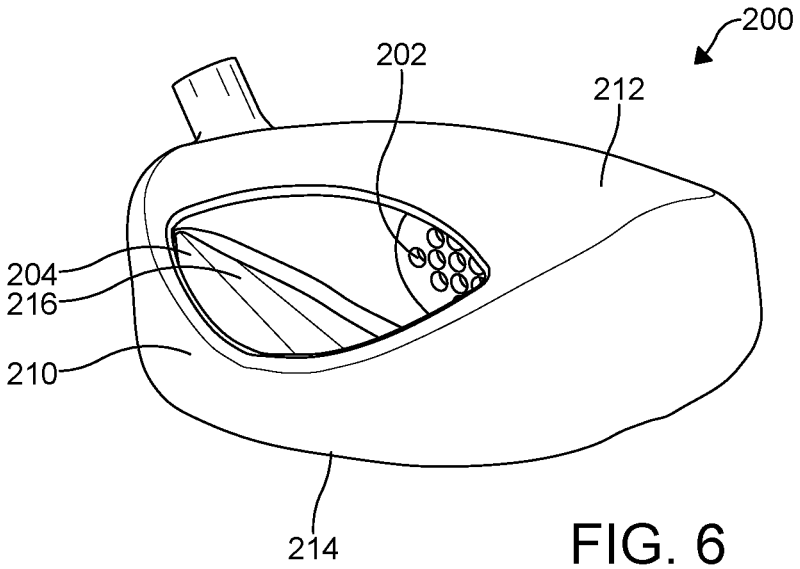
FIG. 6 is a perspective view of the rear and top portions of an exemplary golf club head in accordance with another embodiment of the invention.
Figure 7:
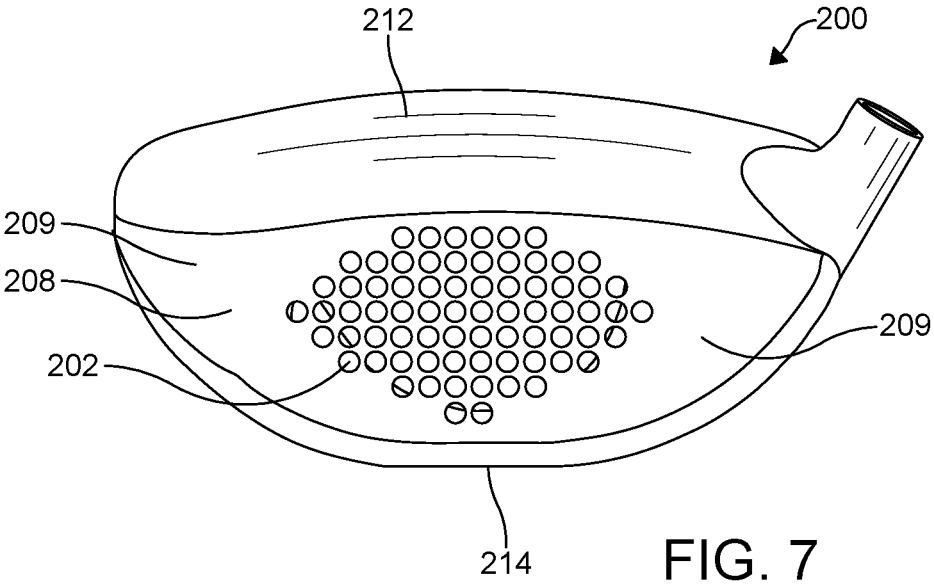
FIG. 7 is a front view of an exemplary golf club head in accordance with another embodiment of the invention.

A variety of different apertures 202 may be used without departing from the scope of the invention as long as they are placed at or near the center portion of the ball striking surface 208. In one embodiment, a single aperture 202 may be used. In other embodiments, as illustrated in FIGS. 6 and 7, a plurality of apertures 202 may be provided. The specific number of apertures 202 may vary as long as they are placed at or around the region where the ball striking surface 208 of the golf club head 200 is designed to make contact with a golf ball when the club is swung. That is, the apertures 202 are preferably positioned only in the central portion, or "sweet spot," of the ball striking surface 208.

More generally, a variety of different number of aperture and/or aperture diameters/sizes may be used without departing from the scope of the invention as long as the apertures 202 enable sufficient air to flow through an interior cavity 216 of the golf club head 200 to create a temporary suction between the golf club head 200 and the golf ball (when the golf ball is struck by the golf club). In one instance, the relationship between aperture 202 number and size may be roughly inverse. The larger the apertures 202 are, the fewer numbers may be needed, and vice versa to create sufficient temporary negative pressure such that the ball may remain on the face 208 of the golf club head 200 for a slightly longer period of time.

In one embodiment, a cluster of apertures 202 may be used without departing from the scope of the invention, as illustrated in FIG. 7. In one limiting embodiment, the cluster of apertures 202 may be disposed over the sweet spot of the golf club face 208. The cluster of apertures 202 may be approximately 2-3 inches wide, preferably 2.25-2.75 inches wide, and may be 1-2 inches high, preferably 1.25-1.75 inches high. In one embodiment, the cluster of apertures 202 is 2.60 inches wide at its widest point, and 1.39 inches long at its highest point. However, the height and/or the width of the aperture cluster may be slightly wider and/or slightly broader and/or slightly longer and/or slightly shorter without departing from the scope of the invention. The cluster of apertures may cover substantially the entire central portion of the golf club face 208 so that the golf club face 208 has solid side portions 209 at the heel and toe thereof that do not include apertures therethrough. That is, the apertures 202 are positioned only in the sweet spot of the golf club face 208.

The golf club head 200 further includes a rear portion 210 opposite of the ball striking surface 208, a top portion 212, a bottom portion 214, an air flow cavity 216, and an air exhaust opening 204. The air exhaust opening 204 is on the top portion 212 of the golf club head 200, adjacent to the rear portion 210. When the golf club head 200 is swung towards a golf ball, air enters the air flow cavity 216 through the plurality of apertures 202 and exits the cavity 216 through the exhaust opening 204.

Moreover, as described elsewhere herein, the rapid motion of the golf club (for example, during the swing phase) forces the air to flow in and out of the golf club head's interior cavity 216 in the manner described herein. This forceful movement of air creates negative pressure or suction that enables the golf ball to remain attached to the face or the strike plate 208 for fractions of seconds longer than with a traditional golf club that does not have the airflow features described herein.

Figure 8:
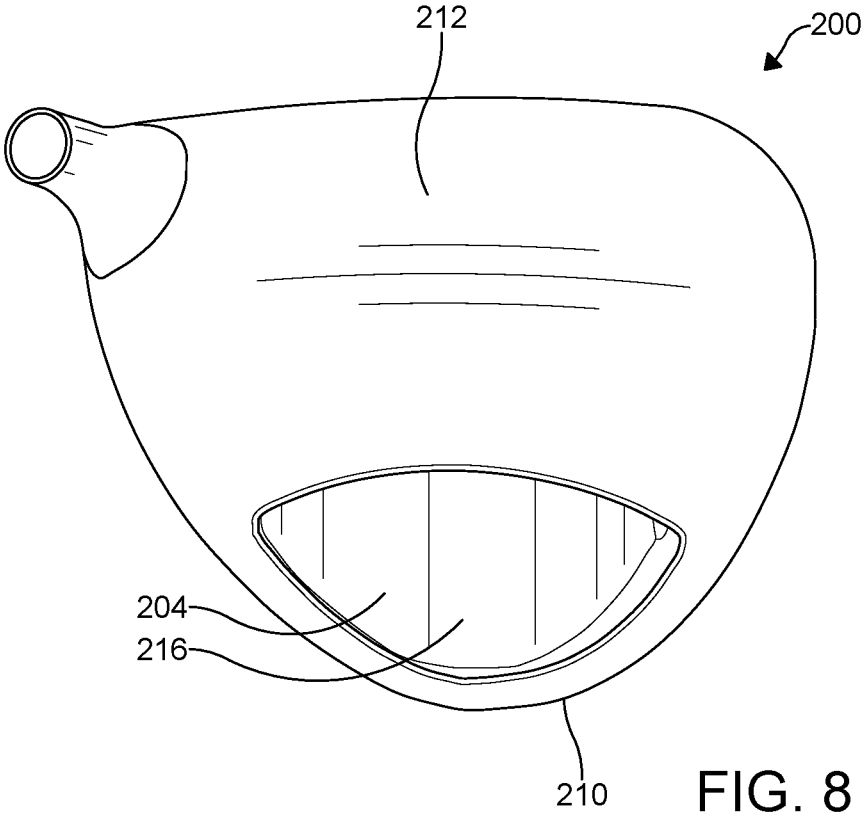
FIG. 8 is a top view of an exemplary golf club head in accordance with another embodiment of the invention.
Figure 9:
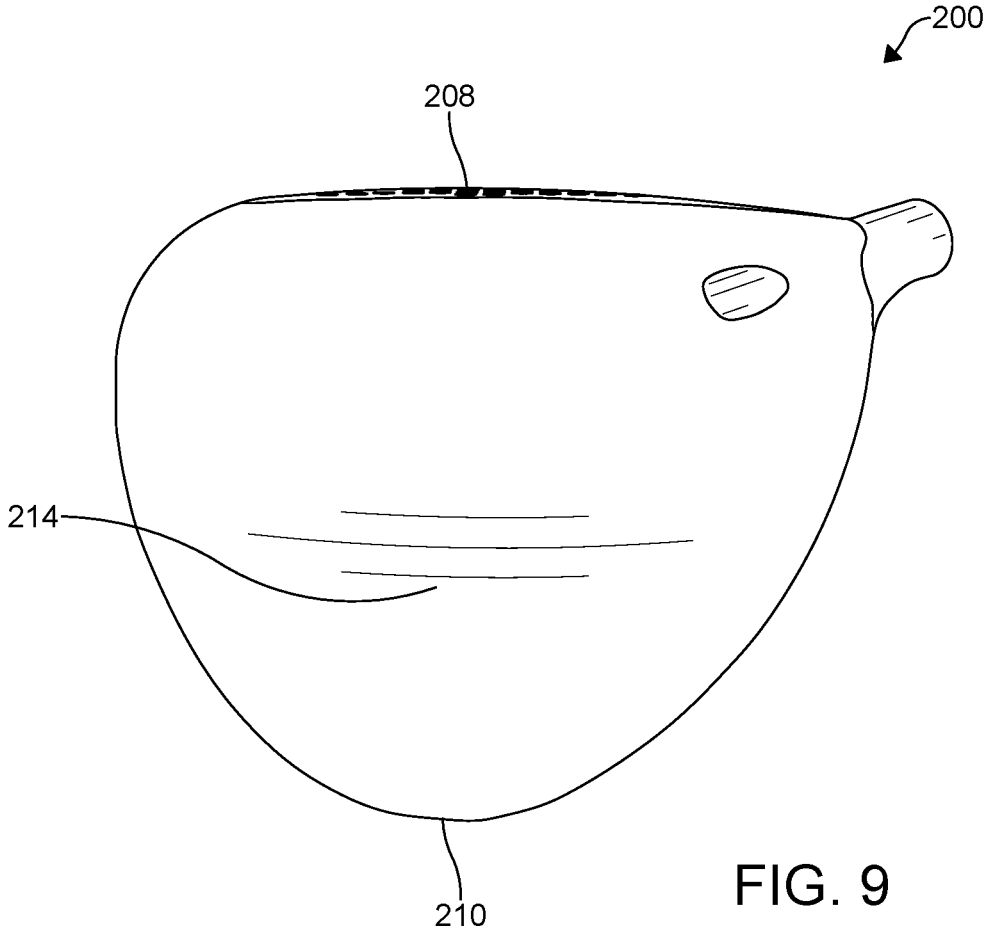
FIG. 9 is a bottom view of an exemplary golf club head in accordance with another embodiment of the invention.

As illustrated in FIGS. 6 and 8, the exhaust opening 204 is placed on the crown portion 212 of the golf club head 200 at or near the back 210 of the golf club head 200. This specific placement of the exhaust opening 204 enables the air to flow in a manner that stabilizes the golf club as it travels through the air when swung. For example, the air flows from the bottom portion of the golf club head 200 to the top portion, which increases the downward rotational force that may be applied via the golf club during a golf swing. Moreover, the specific placement of the exhaust opening 204, which is towards the middle back of the golf club head 200 minimizes undesired movement along the yaw, pitch, and/or roll axes.

ADDITIONAL CONSIDERATIONS

As used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

Some embodiments may be described using the expression "coupled" and "connected" along with their derivatives. For example, some embodiments may be described using the term "coupled" to indicate that two or more elements are in direct physical or electrical contact. The term "coupled," however, may also mean that two or more elements are not in direct contact with each other, but yet still co-operate or interact with each other. The embodiments are not limited in this context.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and Bis false (or not present), A is false (or not present) and Bis true (or present), and both A and B are true (or present).

In addition, use of the "a" or "an" are employed to describe elements and components of the embodiments herein. This is done merely for convenience and to give a general sense of the invention. This description should be read to include one or at least one and the singular also includes the plural unless it is obvious that it is meant otherwise.

Upon reading this disclosure, those of skill in the art will appreciate still additional alternative structural and functional designs for a system and a process for creating an interactive message through the disclosed principles herein. Thus, while particular embodiments and applications have been illustrated and described, it is to be understood that the disclosed embodiments are not limited to the precise construction and components disclosed herein. Various apparent modifications, changes and variations may be made in the arrangement, operation and details of the method and apparatus disclosed herein without departing from the spirit and scope defined in the appended claims.

What is claimed is:

1. A golf club head comprising:

a ball striking surface having a plurality of openings therethrough;

a rear portion opposite of the ball striking surface;

a top portion coupled to the ball striking surface and the rear portion;

a bottom portion opposite of the top portion, wherein the bottom portion is coupled to the ball striking surface and the rear portion;

a single exhaust opening in the top portion adjacent to the rear portion; and a single internal air flow cavity coupled to the plurality of openings and the single exhaust opening so that air enters the single air flow cavity through the plurality of openings and exits the cavity through the single exhaust opening.

2. The golf club head of claim 1, wherein the plurality of openings in the ball striking surface is a cluster of openings positioned in a central portion of the ball striking surface.

3. The golf club head of claim 2, wherein the cluster of openings has a height of 1.25-1.75 inches and a width of 2.25-2.75 inches.

4. The golf club head of claim 1, further comprising an air inlet opening in the bottom portion adjacent to the ball striking surface.

5. The golf club head of claim 4, further comprising an internal ridge disposed in the internal air flow cavity, wherein the internal ridge is positioned between the plurality of openings and the air inlet opening, and wherein the internal ridge is configured to direct air flow from the plurality of openings and the air inlet opening towards the exhaust opening.

6. The golf club head of claim 1, wherein the ball striking surface comprises a region configured to make contact with a golf ball, and wherein the plurality of openings are positioned in or around the region.

* * * * *